US010525302B2

(12) United States Patent
Pei

(10) Patent No.: US 10,525,302 B2
(45) Date of Patent: Jan. 7, 2020

(54) INDOOR FITNESS BICYCLE

(71) Applicant: Xubo Pei, Shenzhen (CN)

(72) Inventor: Xubo Pei, Shenzhen (CN)

( * ) Notice: Subject to any disclaimer, the term of this patent is extended or adjusted under 35 U.S.C. 154(b) by 57 days.

(21) Appl. No.: 15/778,573

(22) PCT Filed: Sep. 23, 2016

(86) PCT No.: PCT/CN2016/099803
§ 371 (c)(1),
(2) Date: May 23, 2018

(87) PCT Pub. No.: WO2017/173784
PCT Pub. Date: Oct. 12, 2017

(65) Prior Publication Data

US 2018/0353804 A1 Dec. 13, 2018

(30) Foreign Application Priority Data

Apr. 6, 2016 (CN) ..... 2016 1 0208866

(51) Int. Cl.
*A63B 22/06* (2006.01)
*A63B 21/00* (2006.01)

(52) U.S. Cl.
CPC ..... *A63B 22/0605* (2013.01); *A63B 21/4035* (2015.10); *A63B 2225/09* (2013.01); *A63B 2225/685* (2013.01)

(58) Field of Classification Search
None
See application file for complete search history.

(56) References Cited

U.S. PATENT DOCUMENTS 4,736,689 A * 4/1988 Stanko ..... A47B 21/0314 108/143
5,685,805 A * 11/1997 Peritz ..... G10D 13/00 482/62
5,931,102 A * 8/1999 Grahl ..... A47B 17/033 108/143
7,335,147 B2 * 2/2008 Jones ..... A63B 71/0622 433/25
7,594,668 B2 * 9/2009 Arceta ..... A61G 12/001 108/147.19
7,686,742 B2 * 3/2010 Tischler ..... A63B 71/00 108/8

(Continued)

*Primary Examiner* — Stephen R Crow
(74) *Attorney, Agent, or Firm* — Novoclaims Patent Services LLC; Mei Lin Wong

(57) ABSTRACT

An exercise bicycle includes an exercise bicycle base body (1), a U-shaped support (2), a handlebar (3), a left sliding rod (4), a right sliding rod (5) and a supporting plate (6), and is characterized in that the supporting plate (6) is located on a front supporting rod of the exercise bicycle base body (1) and disclosed on the U-shaped support (2) through the left sliding rod (4) and the right sliding rod (5), the U-shaped support (2) is fixed to the exercise bicycle base body (1) through screws, and the handlebar (3) has a left end and a right end separately connected to the left sliding rod (4) and the right sliding rod (5) through handlebar adjustment plates. The exercise bicycle has a simple structure, can be adjusted by a certain angle, and allows body builders to study, work or do other activities involving computer operations conveniently while doing exercise.

3 Claims, 2 Drawing Sheets

(56) References Cited

U.S. PATENT DOCUMENTS

| | | | | |
|---|---|---|---|---|
| 8,920,292 | B1 * | 12/2014 | Myers | A63B 22/0605 482/57 |
| 9,139,213 | B2 * | 9/2015 | Trish | A61G 12/001 |
| 9,750,343 | B2 * | 9/2017 | McBride | A63B 22/0605 |
| 10,386,014 | B2 * | 8/2019 | Pei | A47B 23/001 |
| 2010/0206124 | A1 * | 8/2010 | Ferrusi | B62K 21/125 74/551.8 |
| 2013/0281274 | A1 * | 10/2013 | Ferrusi | F16M 13/022 482/148 |
| 2014/0076206 | A1 * | 3/2014 | McCabe | A47B 23/02 108/5 |
| 2017/0259111 | A1 * | 9/2017 | Hsieh | A63B 22/0605 |
| 2018/0338606 | A1 * | 11/2018 | Xiang | A47B 21/02 |
| 2018/0338607 | A1 * | 11/2018 | Xiang | A47B 21/02 |

* cited by examiner

INDOOR FITNESS BICYCLE

BACKGROUND OF THE INVENTION

Technical Field

The invention relates to an exercise bicycle.

Description of Related Art

With the continuous advance of science and technology and the continuous improvement of the living standard of people, the fitness industry has been rapidly developing, and exercise bicycles are becoming more and more popular with people. However, most exercise bicycles on the current market have no other functions except exercising, and people cannot do something else while doing exercise. Occasionally, some people listen to music through headsets while doing exercise. As the life pace of people is becoming faster and faster, sometimes, people have to study, work or do other activities involving computer operations while doing exercise, and thus, an exercise bicycle which can be used for exercise and also can allow body builders to study, work or do other activities involving computer operations conveniently is urgently needed to meet the requirement of people for high-quality life.

BRIEF SUMMARY OF THE INVENTION

The objective of the invention is to develop an exercise bicycle which solves the above problems, has a simple structure and allows body builders to study, work or do other activities involving computer operations conveniently while doing exercise.

The invention is realized through the following technical scheme:

An exercise bicycle of the invention is mainly composed of an exercise bicycle base body, a U-shaped support, a handlebar, a left sliding rod, a right sliding rod and a supporting plate, and is characterized in that the supporting plate 6 is located on a front supporting rod of the exercise bicycle base body 1 and disposed on the U-shaped support through the left sliding rod and the right sliding rod, the U-shaped support is fixed to the exercise bicycle base body through screws, the left end of the handlebar is connected to the left sliding rod through a handle adjustment plate, and the right end of the handlebar is connected to the right sliding rod through a handlebar adjustment plate. Through the structure, people can place computers, books, files or other articles used for study, work or other activities on the exercise bicycle conveniently and thus can study, work or do other activities while doing exercise. Wherein, the left sliding rod is disposed on a left arm of the U-shaped support in a sleeving mode and fixed through an adjustment knob, the supporting plate is fixed to the left sliding rod through a screw, the right sliding rod is disposed on a right arm of the U-shaped support in a sleeving mode and fixed through an adjustment knob, and the supporting plate is fixed to the right sliding rod through a screw. The supporting plate can be driven by the left sliding rod and the right sliding rod to move on the U-shaped support so as to be adjusted according to different use requirements. A drawer is disposed at the bottom of the supporting plate and can store small articles conveniently. The left part and the right part of the supporting plate separately form a left side plate and a right side plate and can be assembled according to requirements. A through hole is formed in the left side plate. A through hole is formed in the right side plate. The exercise bicycle is convenient to use and realizes the design purpose.

The invention has the following advantages:

1. The exercise bicycle of the invention has a simple structure, can be adjusted by a certain angle, and allows body builders to study, work or do other activities involving computer operations conveniently while doing exercises.

BRIEF DESCRIPTION OF THE SEVERAL VIEWS OF THE DRAWINGS

The invention is further described with the drawings as follows.

In the figures: 1, exercise bicycle base body; 2, U-shaped support; 3, handlebar; 31, handlebar adjustment plate; 4, left sliding rod; 41, adjustment knob; 5, right sliding rod; 6, supporting plate; 61, drawer; 62, left side plate; 63, right side plate; 64, through hole.

DETAILED DESCRIPTION OF THE INVENTION

Figure 1:
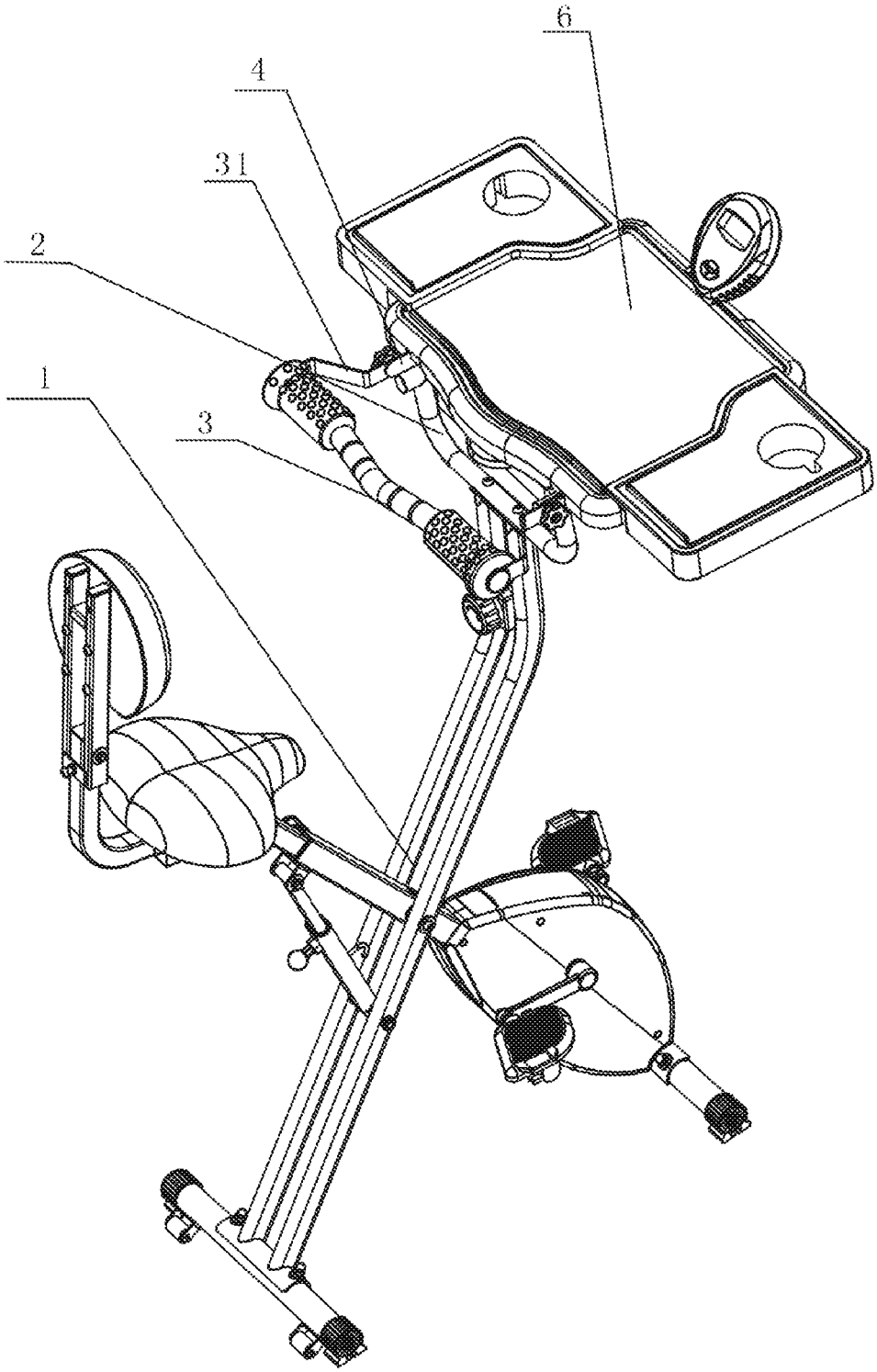
FIG. 1 is a structural view of the invention.
Figure 2:
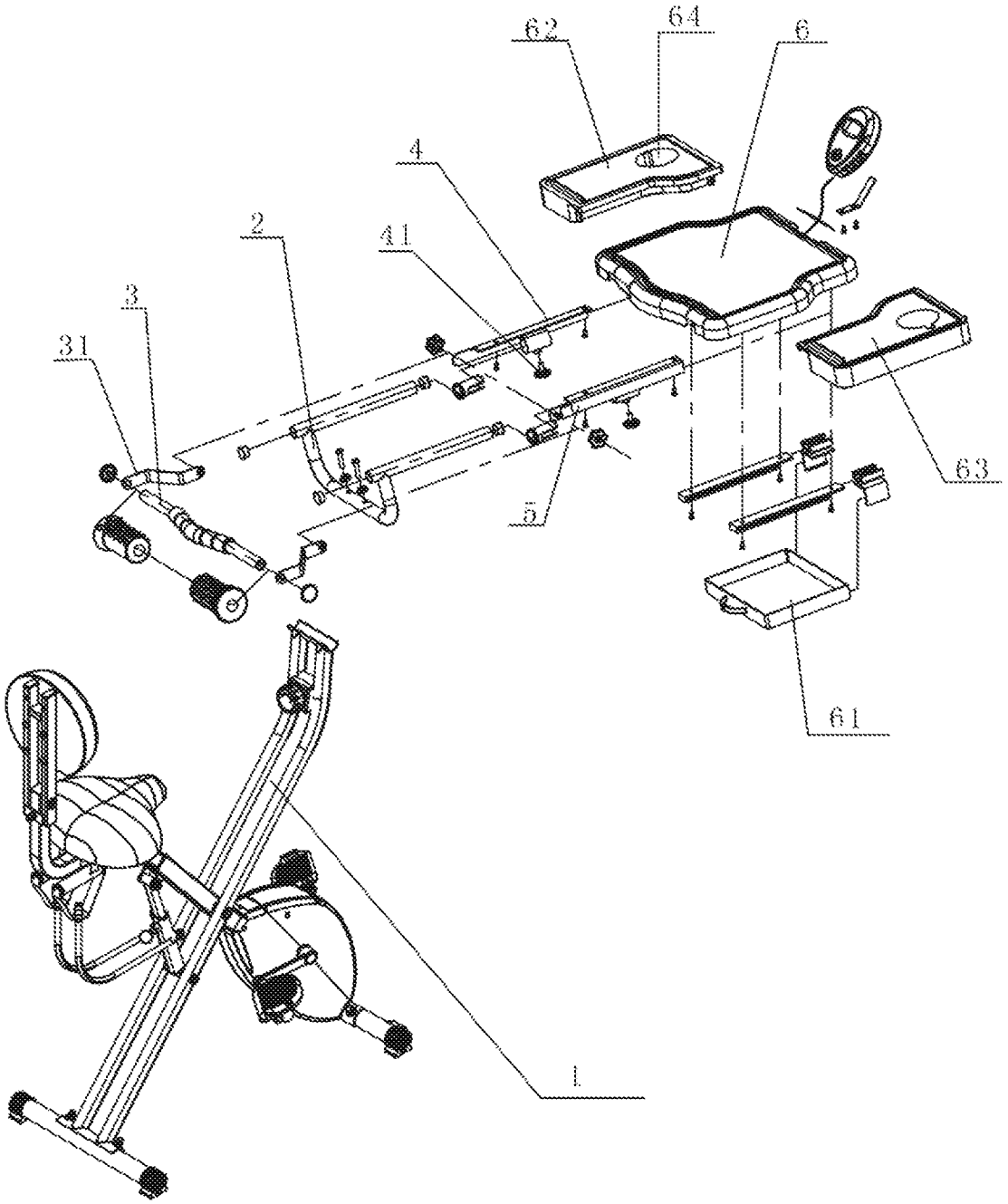
FIG. 2 is an exploded structural view of the invention.

As is shown in FIG. 1 and FIG. 2, an exercise bicycle of the invention is mainly composed of an exercise bicycle base body 1, a U-shaped support 2, a handlebar 3, a left sliding rod 4, a right sliding rod 5 and a supporting plate 6, and is characterized in that the supporting plate 6 is located on a front supporting rod of the exercise bicycle base body 1 and disposed on the U-shaped support 2 through the left sliding rod 4 and the right sliding rod 5, the U-shaped support 2 is fixed to the exercise bicycle base body 1 through screws, the left end of the handlebar 3 is connected to the left sliding rod 4 through the a handlebar adjustment plate 31, and the right end of the handlebar 3 is connected to the right sliding rod 5 through a handlebar adjustment plate. Wherein, the left sliding rod 4 is disposed on a left arm of the U-shaped support 2 in a sleeving mode and fixed through an adjustment knob 41, the supporting plate 6 is fixed to the left sliding rod 4 through a screw, the right sliding rod 5 is disposed on a right arm of the U-shaped support 2 in a sleeving mode and fixed through an adjustment knob, the supporting plate 6 is fixed to the right sliding rod through a screw, a drawer 61 is disposed at the bottom of the supporting plate 6, the left part and the right part of the supporting plate separately form a left side plate 62 and a right side plate 63, a through hole 64 is formed in the left side plate 62, and a through hole is formed in the right side plate 63. Thus, the design purpose is realized.

The exercise bicycle of the invention has a simple structure, can be adjusted to a certain angle and allows exercise enthusiasts to study, work or do other activities involving computer operations conveniently while doing exercise, thereby being widely applied to the exercise bicycle field.

What is claimed is:

1. An exercise bicycle, comprising an exercise bicycle base body (1), a U-shaped support (2), a handlebar (3), a left sliding rod (4), a right sliding rod (5) and a supporting plate (6); characterized in that the supporting plate (6) is located on a front supporting rod of the exercise bicycle base body (1) and disposed on the U-shaped support (2) through the left sliding rod (4) and the right sliding rod (5), the U-shaped support (2) is fixed to the exercise bicycle base body (1) through screws, a left end of the handlebar (3) is directly connected to the left sliding rod (4) through a handlebar adjustment plate (31), and a right end of the handlebar (3) is directly connected to the right sliding rod (5) through a handlebar adjustment plate.

2. The exercise bicycle according to claim 1, wherein the left sliding rod (4) is disposed on a left arm of the U-shaped support (2) in a sleeving mode and fixed through an adjustment knob (41), the supporting plate (6) is fixed to the left sliding rod (4) through a screw, the right sliding rod (5) is disposed on a right arm of the U-shaped support (2) in a sleeving mode and fixed through an adjustment knob, and the supporting plate (6) is fixed to the right sliding rod (5) through a screw.

3. The exercise bicycle according to claim 1, wherein a drawer (61) is disposed at a bottom of the supporting plate (6), a left part and a right part of the supporting plate (6) separately form a left side plate (62) and a right side plate (63), a through hole (64) is formed in the left side plate (62), and a through hole is formed in the right side plate (63).

* * * * *